US009943861B2

(12) United States Patent
Oldebäck et al.

(10) Patent No.: US 9,943,861 B2
(45) Date of Patent: Apr. 17, 2018

(54) CENTRIFUGAL SEPARATOR WITH A CONTROL UNIT FOR SPEED CONTROL

(75) Inventors: Tomas Oldebäck, Vendelso (SE); Rolf Ridderstråle, Stockholm (SE); Robert Geiding, Tullinge (SE); Per Fonser, Enskededalen (SE)

(73) Assignee: ALFA LAVAL CORPORATE AB, Lund (SE)

( * ) Notice: Subject to any disclaimer, the term of this patent is extended or adjusted under 35 U.S.C. 154(b) by 834 days.

(21) Appl. No.: 13/504,385

(22) PCT Filed: Oct. 13, 2010

(86) PCT No.: PCT/SE2010/051102

§ 371 (c)(1),
(2), (4) Date: Jul. 13, 2012

(87) PCT Pub. No.: WO2011/053224

PCT Pub. Date: May 5, 2011

(65) Prior Publication Data

US 2012/0267303 A1 Oct. 25, 2012

(30) Foreign Application Priority Data

Oct. 29, 2009 (SE) ..... 0950805

(51) Int. Cl.
*B04B 1/20* (2006.01)

(52) U.S. Cl.
CPC .... *B04B 1/2016* (2013.01); *B04B 2001/2066* (2013.01)

(58) Field of Classification Search
CPC ..... B04B 1/08; B04B 1/2008; B04B 1/2016; B04B 2001/2041; B04B 2001/2083;
(Continued)

(56) References Cited

U.S. PATENT DOCUMENTS 3,684,450 A * 8/1972 Adler et al. ..... B04B 5/0442 210/787
3,741,766 A 6/1973 La Monaca
(Continued)

FOREIGN PATENT DOCUMENTS

CN 1305397 A 7/2001
EP 0123491 A2 10/1984
(Continued)

OTHER PUBLICATIONS

JP 03293045 Machine Translation.*
(Continued)

*Primary Examiner* — Walter D Griffin
*Assistant Examiner* — Shirley S Liu
(74) *Attorney, Agent, or Firm* — Murtha Cullina LLP

(57) ABSTRACT

A centrifugal separator for separating solid particles from a liquid mixture includes a rotor body. The rotor body has a separation chamber with an inlet for the liquid mixture, one or more liquid outlets for a liquid separated from the liquid mixture, a sludge outlet for the separated solid particles, a screw conveyor adapted to rotate in the rotor body, at a speed differing from the rotational speed of the rotor body, for transporting the separated solid particles in the separation chamber towards and out of the sludge outlet, a drive arrangement adapted to rotate the rotor body and the screw conveyor at their respective speeds, and a control unit which is adapted to control the drive arrangement to rotate the rotor body at a first speed during a separation phase and at a second speed, which is lower than the first speed, during a particle discharge phase.

16 Claims, 2 Drawing Sheets

(58) Field of Classification Search
CPC ..... B04B 2001/2091; B04B 9/08; B04B 9/10; B04B 11/02; B04B 12/00; B04B 3/04; B04B 13/00
USPC ..... 494/5, 6, 7, 8, 9, 42, 45, 50, 51, 52, 53, 494/55, 57, 66, 79, 84
See application file for complete search history.

(56) References Cited

U.S. PATENT DOCUMENTS

| | | | | | |
|---|---|---|---|---|---|
| 3,861,584 | A * | 1/1975 | Dudrey | B04B 11/04 366/194 | |
| 4,085,888 | A * | 4/1978 | Jager | 494/9 | |
| 4,820,256 | A * | 4/1989 | Nordstrom | B04B 1/14 494/27 | |
| 5,857,955 | A | 1/1999 | Phillips et al. | | |
| 5,913,767 | A | 6/1999 | Feldkamp et al. | | |
| 6,155,964 | A | 12/2000 | Hensley | | |
| 6,368,264 | B1 | 4/2002 | Phillips et al. | | |
| 6,716,153 | B2 * | 4/2004 | Stroucken et al. | 494/53 | |
| 7,115,202 | B2 | 10/2006 | Fleuter et al. | | |
| 7,387,602 | B1 * | 6/2008 | Kirsch | 494/8 | |
| 8,790,233 | B2 * | 7/2014 | Ridderstrale | B04B 1/08 494/53 | |

FOREIGN PATENT DOCUMENTS

| | | | | |
|---|---|---|---|---|
| GB | 423162 | | 1/1935 | |
| GB | 1235066 | A | 6/1971 | |
| JP | 53-049372 | A | 5/1978 | |
| JP | 03-293045 | A | 12/1991 | |
| JP | 03293045 | A * | 12/1991 | |
| JP | 11-506383 | | 6/1999 | |
| JP | 11-253840 | A | 9/1999 | |
| JP | 3293045 | B2 | 6/2002 | |
| JP | 2002518159 | A | 6/2002 | |
| JP | 2002523210 | A | 7/2002 | |
| JP | 2003-144973 | A | 5/2003 | |
| JP | 2004-154694 | | 6/2004 | |
| JP | 42-14235 | | 1/2009 | |
| KR | 10-1984-0008597 | | 12/1984 | |
| WO | 95/15820 | A1 | 6/1995 | |
| WO | 97/20634 | A1 | 6/1997 | |
| WO | 1999065610 | A1 | 12/1999 | |
| WO | 00/10714 | A1 | 3/2000 | |
| WO | WO 2008058340 | A1 * | 5/2008 | B04B 11/04 |
| WO | 2008140378 | A1 | 11/2008 | |
| WO | WO 2008140378 | A1 * | 11/2008 | B04B 1/08 |

OTHER PUBLICATIONS

Chines Office Action with Search Report for corresponding Chinese Application 201080049645.4 (PCT/SE2010/051102) dated Sep. 30, 2013.

International Search Report for PCT/SE10/051102, dated Mar. 10, 2011.

English Abstract for Japanese Patent Application No. 63319075A, dated Dec. 27, 1988.

Decision of Rejection issued in corresponding Japanese Patent Application No. 2014-100591 dated Apr. 5, 2016.

Japanese Office Action for corresponding JP Appln. No. 2014-100591 dated Sep. 19, 2017.

* cited by examiner

CENTRIFUGAL SEPARATOR WITH A CONTROL UNIT FOR SPEED CONTROL

FIELD OF THE INVENTION

The present invention relates to a centrifugal separator for separating solid particles from a liquid mixture, the centrifugal separator comprising a rotor body which is rotatable around an axis of rotation, the rotor body having a separation chamber with an inlet for the liquid mixture, at least one liquid outlet for a separated liquid from the liquid mixture, a sludge outlet for the separated solid particles (also known as sludge), a screw conveyor arranged to rotate inside the rotor body around the axis of rotation for transporting the separated solid particles in the separation chamber towards and out of the sludge outlet, and a drive arrangement adapted to rotate the rotor body and the screw conveyor at their respective speeds. The present invention also relates to a method for separating solid particles from a liquid mixture.

BACKGROUND OF THE INVENTION

WO 2008/140378 discloses a centrifugal separator initially defined for purifying a fluid from contaminating particles. The particles separated from the fluid deposit themselves on the inside of the rotor body in the form of a layer of sludge, wherein the screw conveyor is arranged for transporting the sludge towards and out of the outlet. However, this layer of sludge may be difficult to transport due to the viscosity of the sludge (the viscosity may be too high or low for good transportation characteristics). Furthermore, when rotating the rotor body at high speed the sludge transportation problem may be worsened. The resulting high centrifugal forces have a compressing effect on the sludge making it more difficult to transport out of the sludge outlet. Failure to discharge the sludge from the rotor body will cause a relatively solid sludge phase to grow radially inwards towards the axis of rotation, impairing the degree of separation and ultimately rendering continued separation impossible because of obstruction.

SUMMARY OF THE INVENTION

An object of the present invention is to provide a centrifugal separator and a method for effectively separating and transporting the solid particles (sludge) from the liquid mixture and out of the rotor body.

According to the present invention, the centrifugal separator includes a control unit which is adapted to control the drive arrangement to rotate the rotor body at a first speed during a separation phase and at a second speed, which is lower than the first speed, during a particle discharge phase.

Consequently, the centrifugal separator according to the invention is operating in a cycle comprising said separation phase and said discharge phase.

During the separation phase of the operating cycle, the rotor body is rotating at a high speed, whereby the particles are effectively separated from the liquid mixture in the separation chamber of the rotor body. These separated particles are deposited on the inside of the rotor body. At such a high rotational speed the deposited particles (or sludge) may be difficult to discharge from the separator, at least in a sufficient amount. Hence, with time the deposited particles will cause a sludge layer to grow radially inwards towards the axis of rotation.

Before the growing layer of sludge becomes a problem, the particle discharge phase of the present invention is initiated. During the particle discharge phase of the operating cycle, the rotor body is brought to rotate at a slower speed, whereby the centrifugal forces are decreased so that the screw conveyor may transport the sludge towards and out of the sludge outlet more easily. When essentially all of the sludge or at least a sufficient amount of sludge has been discharged from the separator, the rotor body is accelerated back to high speed rotation for the separation phase of the next operating cycle.

The differential speed between the screw conveyor and the rotor body may be activated exclusively during the particle discharge phase. However, according to an embodiment of the invention the control unit is adapted to control the drive arrangement to rotate the screw conveyor at a different speed than the rotor body during both the separation phase and the particle discharge phase. Through such a differential speed between the rotor body and the screw conveyor, some amount of the sludge may be discharged even during the separation phase. At any rate, through the upholding of the differential speed during the separation phase, the screw conveyor will distribute and work on the sludge to reduce some negative effects caused by the centrifugal forces compressing the sludge. One of those negative effects is that compressing the sludge will make it more difficult to discharge. Another negative effect is that the compressed sludge may be unevenly distributed in the rotor body, causing an unbalance with harmful vibrations of the centrifugal separator during operation.

According to a further embodiment of the invention the control unit is adapted to control the drive arrangement to change, preferably increase, the differential speed between the screw conveyor and the rotor body in the particle discharge phase relative the separation phase. Through such a change the sludge may be discharged at a rate that is suitable. Preferably, the sludge would be discharged at a relatively high rate (by increasing the differential speed) to make the discharge phase short in duration.

According to a further embodiment of the invention the control unit is adapted to control the drive arrangement to rotate the rotor body at the first speed for a predetermined time. After the predetermined time in the separation phase, the control unit will automatically initiate a discharge phase, whereby the sludge is discharged. In one embodiment, a predetermined time is manually set by an operator. In another embodiment, the predetermined time is calculated from operating parameters of the centrifugal separator measured by various sensors, such as, but not limited to, sensors registering a feed rate and concentration of particles in the feed through the inlet.

According to another embodiment of the invention the control unit is adapted to initiate a particle discharge phase when receiving a threshold value from an arrangement measuring an operating parameter of the centrifugal separator. Such an arrangement may be a torque measuring arrangement for the screw conveyor, which torque may be measured directly through a torque sensor or by calculating the torque using the current consumed by the electric motor of the screw conveyor. Consequently, when the torque increases above a specific threshold value, the discharge phase would be initiated. Another arrangement for measuring an operating parameter may for example be a turbidity sensor associated with at least one liquid outlet, whereby the discharge phase is initiated when the turbidity of the purified liquid increases above a specific threshold value. Another possible alternative is a capacity sensor arranged in the light liquid outlet to measure the concentration of heavy liquid particles (e.g. water) in light liquid (e.g. oil), when separating two different liquid phases, whereby the discharge phase is initiated when the concentration of heavy liquid reaches a certain threshold. Furthermore, pressure sensors measuring the pressure in the liquid outlet may also be utilized to trigger the discharge phase, when the pressure in the liquid outlet drops below a specific threshold value indicating a sludge layer which obstructs the heavy and/or light liquid flow passages.

According to yet another embodiment of the invention the control unit is adapted to control the drive arrangement to rotate the rotor body at the second speed for a predetermined time. In one embodiment, a predetermined time is manually set by an operator or it could be calculated from operating parameters measured by various sensors. This discharge phase time would be dependent on such parameters as the accumulated sludge amount, the differential speed between the screw conveyor and the rotor body, the type of sludge and viscosity of the sludge etc.

In one embodiment, both the discharge phase and separation phase are controlled by combining the above described predetermined time and the threshold value of the operating parameter. In another embodiment, the separation phase and discharge phase have set default predetermined times combined with measured threshold values, whereby a discharge phase would be initiated in advance if the threshold value was reached before the default predetermined time had lapsed.

According to yet another embodiment of the invention the centrifugal separator is arranged to reduce or interrupt the feed through the inlet during the particle discharge phase. Consequently, the mixture may be introduced into the separation chamber at a reduced rate during the discharge phase when the separation performance is reduced. If needed by the process the feed may be stopped until full rotor speed is re-established. When the rotor body is rotating at full speed with the increased separation performance in the separation phase, the feed rate is re-established.

According to yet another embodiment of the invention the rotor body is rotatably supported only at its one end through a rotor shaft, which is arranged so that the axis of rotation extends substantially vertically. This type of centrifugal separator is typically more light weight than for example a decanter centrifuge, which comprises a relatively heavy rotor body with a horizontal axis of rotation. The rotor body according to this embodiment is more suitable to accelerate back and forth between a separation phase and discharge phase. Such a separator will many times include a stack of truncated conical separation discs in the separation chamber, whereby the separation efficiency is improved. Furthermore, the inlet of such a separator would preferably include an inlet pipe, which extends into the rotor body at its one end, the liquid outlet for separated liquid including at least one outlet channel, which extends out of the rotor body at its one end, and the sludge outlet for separated solids situated at the opposite other end of the rotor body.

According to yet another embodiment of the invention the drive arrangement includes a so called Harmonic Drive gear device, also known as a strain wave gearing device, arranged between the rotor body and the screw conveyor.

BRIEF DESCRIPTION OF THE DRAWING

The invention will be further explained by a description of an embodiment in the following with reference to the accompanying drawing.

DETAILED DESCRIPTION OF AN EMBODIMENT OF THE INVENTION

Figure 1:
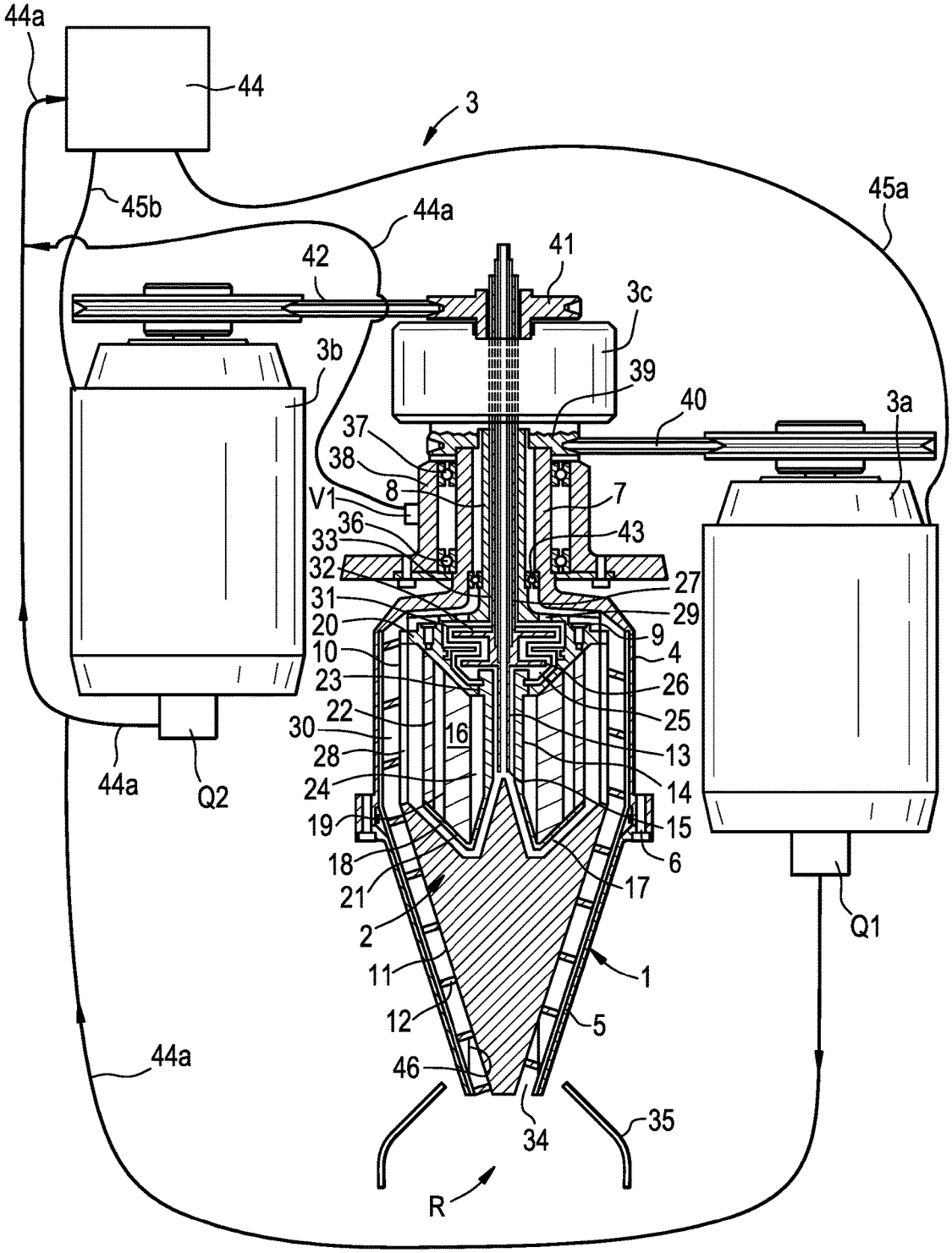
FIG. 1 discloses schematically a view of a centrifugal separator according to an embodiment of the invention.
Figure 2:
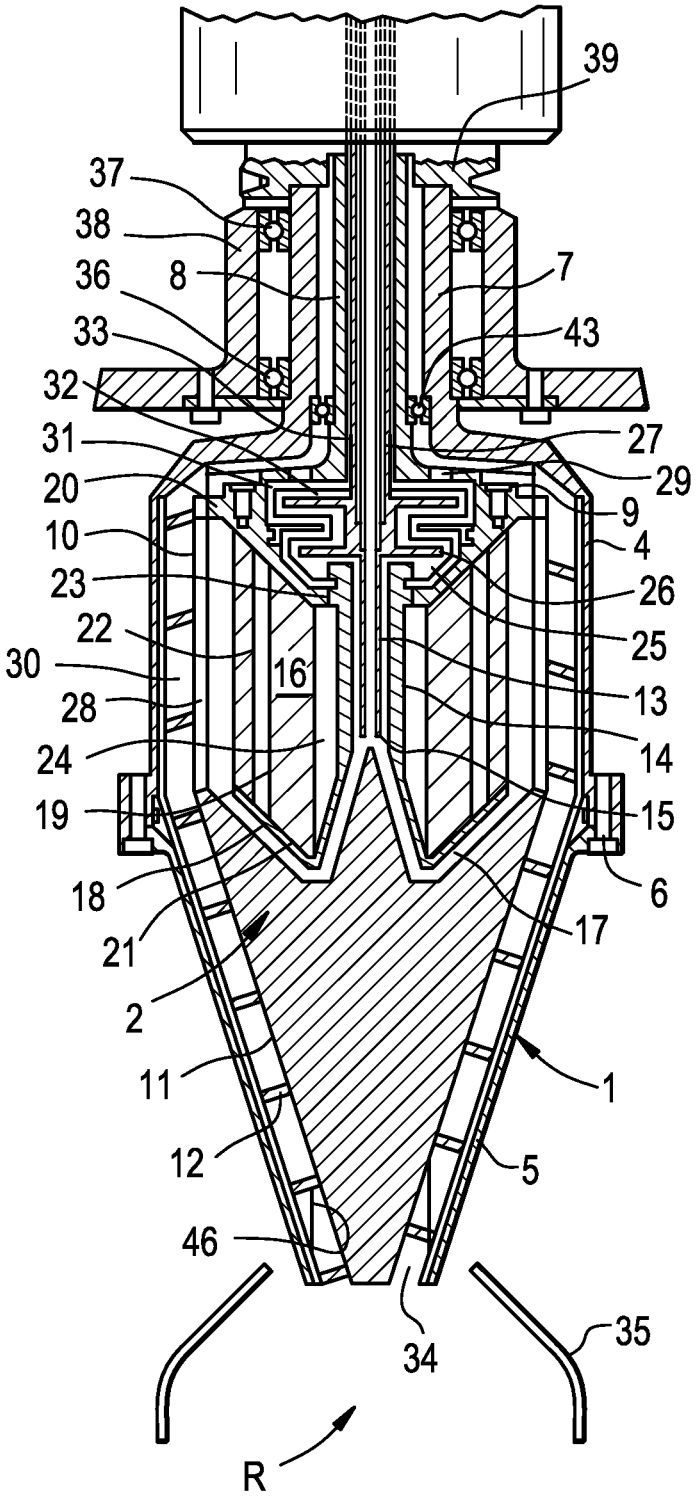
FIG. 2 is an enlarged view of the centrifugal separator of FIG. 1.

FIG. 1 discloses an embodiment of the invention. The centrifugal separator includes a rotor body 1, which is rotatable at a speed around a vertical rotational axis R, a screw conveyor 2 arranged in the rotor body 1 and rotatable around the same rotational axis R, however at a speed differing from the rotational speed of the rotor body 1. A drive arrangement 3 is adapted for rotation of the rotor body 1 and the screw conveyor 2 at their respective speeds. The drive arrangement 3 includes two electric motors 3*a* and 3*b* and a gear device 3*c*.

The rotor body 1 has a cylindrical upper rotor body portion 4 which is connected with a conical lower rotor body portion 5 by means of bolts 6. Alternative connection members can of course be used. The cylindrical rotor body portion 4 includes an extension axially upwards in the form of a hollow rotor shaft 7, which is connected to one of said electric motors 3*a* for rotating the rotor body 1 around the axis of rotation R.

A further hollow shaft 8 extends into the rotor body 1 through the interior of the hollow rotor shaft 7. The shaft 8 supports the screw conveyor 2 by means of fasteners such as screws 9. The hollow shaft 8 drivingly connects the other of said electric motors 3*b* with the screw conveyor 2 via said gear device 3*c*. This hollow shaft 8 is referred to as a conveyor shaft 8 in the following. The screw conveyor 2 comprises an upper cylindrical part 10 which extends axially inside the cylindrical rotor body portion 4, a lower conical part 11 which extends axially inside the conical rotor body portion 5, and a conveying thread 12 which extends in a screw-like manner along the upper cylindrical part 10 and the lower conical part 11 of the screw conveyor 2. The screw conveyor 2 may of course have more than one conveying thread, e.g. two, three or four conveying threads, which all extend in a screw-like manner along the inside of the rotor body 1.

An inlet pipe 13 for a liquid mixture to be treated in the rotor body 1 extends through the conveyor shaft 8 and leads on into a central sleeve 14 in the interior of the screw conveyor 2. The central sleeve 14 delimits an inlet chamber 15 for the liquid mixture, wherein the inlet chamber 15 communicates with a separation chamber 16 via radially extending distribution channels 17. A number of wings 18 are distributed around the axis of rotation R and extend into a lower part of the inlet chamber 15 and further defining radially extending side walls of the distribution channels 17. The wings 18 are arranged to cause the liquid mixture in the inlet chamber 15 and the distribution channels 17 to rotate with the screw conveyor 2. Consequently, the distribution channels 17 are arranged between the wings 18.

The separation chamber 16 is an annular space that surrounds the inlet chamber 15 and comprises a stack of truncated conical separation discs 19. The stack is fitted radially inside the cylindrical part 10 of the screw conveyor 2 and arranged coaxially with the axis of rotation R. The conical separation discs 19 are held together axially between an upper conical support plate 20 and a lower conical support plate 21. As can be seen, the lower conical support plate 21 is formed in one piece with the central sleeve 14. The separation discs 19 comprise holes which form channels 22 for axial flow or distribution of liquid through the stack of separation discs 19 in the centrifugal separator. The lower support plate 21 comprises a corresponding hole, whereby the distribution channels 17 communicate with the channels 22 for axial flow of liquid in the stack of separation discs 19. The upper conical support plate 20 comprises a number of holes 23 which connect a radially inner annular space 24, within the stack of separation discs 19, with a relative lower density or light liquid outlet chamber 25. Such light liquid may for example be oil. A so called paring disc 26 for discharging purified light liquid is disposed within the outlet chamber 25. The paring disc 26 is stationary and firmly connected to the inlet pipe 13, wherein the paring disc 26 is communicating with an outlet channel 27 extending in an outlet pipe which surrounds the inlet pipe 13.

The cylindrical part 10 of the screw conveyor 2 radially surrounds the stack of separation discs 19, wherein the cylindrical part 10 comprises a number of axially extending apertures 28 which are distributed around the axis of rotation R. The axially extending apertures 28 are provided to allow for the separated sludge to pass through and deposit on the inside of the cylindrical wall of the rotor body 1. Liquid will of course also be able to pass through the apertures 28 in the cylindrical part 10. The conveyor shaft 8 comprises a number of holes 29 which connect an annular space 30 situated radially outside the cylindrical part 10 with a relative higher density or heavy liquid outlet chamber 31. Such heavy liquid may for example be water. A paring disc 32 for discharging heavy liquid is disposed within this outlet chamber 31, wherein the paring disc 32 communicates with an outlet channel 33 for the heavy liquid. The heavy liquid outlet channel 33 extends in an outlet pipe which surrounds the outlet pipe and channel 27 for the light liquid.

The rotor body 1 has at its lower end a central and axially directed outlet 34 for separated particles (sludge). This sludge outlet 34 defines the initially mentioned sludge outlet for solid particles. In connection with this sludge outlet 34, the rotor body is surrounded by device 35 for intercepting sludge which leaves the sludge outlet 34. The sludge is disclosed in the drawing in the form of accumulations at the radially outer portion of the conveying thread 12, on the latter's side which faces toward the sludge outlet 34. The screw conveyor 2 may be made in one piece of plastic material, possibly fibre-reinforced such material. The conical part 11 may have a hollow interior or cavity, which is either sealed or open to the surrounding. If desired, the cavity being possibly filled with some material having a relatively low density, such as cellular plastic or the like.

The rotor body 1 is supported through the rotor shaft 7 by two axially separated bearings 36 and 37, respectively. These bearings are supported in turn by a sleeve 38, which is resiliently connected to a frame (not shown). The rotor shaft 7 supports a belt pulley 39, around which a driving belt 40 extends. The driving belt 40 is connected to the electric motor 3*a* for rotating the rotor body 1.

FIG. 1 schematically shows a gear device 3*c*. The gear device 3*c* may for example be a Harmonic Drive gear device, which is also known as a strain wave gearing device. This gear device 3*c* is hereinafter described in a manner also described in WO 99/65610, which is also referred to for a more detailed drawing of the gear device. Such a gear device comprises a stiff cylindrical first gear member (not shown), which is firmly connected with the pulley 39 and, thereby, is also firmly connected with the rotor shaft 7. The cylindrical first gear member has internal cogs or teeth, which are formed on the inside of a ring, which constitutes a part of the cylindrical first gear member. A second gear member (not shown) is situated radially inside of the cylindrical first gear member and includes a thin flexible sleeve. The second gear member is supported through a supporting member by the conveyor shaft 8 and has on the flexible sleeve external cogs or teeth situated opposite to said internal cogs or teeth on the ring of the surrounding cylindrical first gear member. In an unloaded state the teeth-provided flexible sleeve is circular-cylindrical and it has a smaller pitch diameter than the teeth-provided ring. Thus, the flexible sleeve has a smaller number of teeth than the ring. The gear device also includes a third gear member in the form of a so-called wave generator, which surrounds the rotational axis R and supports a belt pulley 41. A belt 42 extends around the belt pulley 41 and is connected to the electric motor 3*b* for rotating the screw conveyor 2 at said differential speed.

The wave generator has an elliptically formed surrounding portion provided with two end portions or protuberances placed diametrically each on one side of the rotational axis R, said protuberances being dimensioned such that they locally deform the flexible sleeve, i.e. the second gear member, so that the external teeth of the sleeve are kept locally in engagement with the internal teeth of the surrounding stiff first gear member, i.e. the ring. Other parts of the gear members are situated radially spaced from each other in the areas of their respective teeth and, thus, are not in engagement with each other more than in the areas of the protuberances.

Between the respective protuberances of the wave generator and the flexible sleeve there are balls included in a ball bearing, which surrounds the wave generator and, thus, is also ellipse-formed. Upon rotation of the wave generator relative to the flexible sleeve, or vice versa, the protuberances will successively press, through the balls in the ball bearing, the external teeth of the sleeve into engagement with the internal teeth of the stiff cylindrical first gear member. Due to the fact that the number of external teeth on the flexible sleeve is smaller than the number of internal teeth on the surrounding stiff ring, the sleeve—upon rotation of the wave generator relative to the ring in a certain direction around the rotational axis R—will move in the opposite direction around the rotational axis R relative to the ring. In other words, if the rotor body 1 is rotated by means of the drive pulley 39 around the rotational axis R and the screw conveyor 2 is entrained in this rotation by teeth engagement between the ring and the sleeve, a relative movement, i.e. a difference in rotational speed, between the rotor body 1 and the screw conveyor 2 may be accomplished by rotating the wave generator with the electric motor 3*b* and belt 42 around the rotational axis R at a speed differing from that by which the wave generator is entrained by the rotor body.

As can be seen from FIG. 1, a bearing 43 is arranged between the conveyor shaft 8 and the surrounding rotor shaft 7. There is another bearing inside the gear device 3*c*, whereby this bearing and bearing 43 constitute the two bearings by means of which the screw conveyor 2 is journalled in the rotor body 1.

FIG. 1 also shows the electrical motors 3*a* and 3*b*, which are arranged for driving the rotor body 1 and the screw conveyor 2 respectively. In connection to the electrical motors 3*a* and 3*b* there is arranged a control unit 44 that is adapted to drive the electrical motors 3*a* and 3*b* respectively at varying speeds. The electrical motors 3*a* and 3*b* in the disclosed embodiment have a common control unit 44. It is however evident that each one of the two motors 3*a* and 3*b* may be controlled by an individual control unit. The control unit 44 is connected through signal cables 45*a* and 45*b* to the motors 3*a* and 3*b*. The motors 3*a* and 3*b* may be a direct-current motor or an alternating-current motor; either a synchronous motor or an asynchronous motor. Depending upon the type of the electrical motor the control unit 44 may be designed in many different ways self-evident for a person skilled in the art of electrical motors.

The control unit 44 includes a device for driving its electrical motors 3*a* and 3*b* at different speeds; either so that a limited number of speeds can be obtained or so that a continuous change of the motor speed can be performed. Different kinds of devices for speed regulation of motors (both direct-current and alternate-current motors) are well known and need no closer description here. For a direct-current motor a simple device for voltage control may be used. For an alternate-current motor various kinds of frequency control equipment may be used.

The control unit 44 is connected to one or several different sensors (e.g., sensor arrangements such as a vibration sensor V1 on the centrifugal separator and/or torque sensors Q1 and Q2 on the motors 3*a* and 3*b*, respectively) and adapted to treat the signal(s) coming from the sensor(s). The incoming signal(s) from the sensor arrangements such as the vibration sensor V1 on the centrifugal separator and/or the torque sensors Q1 and Q2, is depicted in FIG. 1 with arrows 44A pointing at the control unit 44. Consequently, the control unit 44 will treat (e.g., process) the signal(s) and produce (e.g., generate) a control signal in signal cables 45*a* and 45*b* for the controlling of the drive arrangement, for example, driving of the electrical motor 3*a* and 3*b*. The incoming signal(s) from the sensor(s) may be used in an automatic control of the centrifugal separator, wherein the discharge phase is initiated on the basis of a sensed value. The control signal(s) may also be used to control optimize rotor body speed and screw conveyor speed in both the separation phase and the discharge phase. However, in the simplest case the control unit 44 may include a manual operation, wherein an operator programs the control unit 44 (e.g., provides incoming signals) for operation of the electrical motors 3*a* and 3*b* by means of manually programmed control signals. Hereby, the operator may set parameters such as separation phase time (duration in minutes or hours), discharge phase time (duration in seconds or minutes), rotor body speed (rpm) during the separation phase, rotor body speed (rpm) during discharge phase, and differential speed (rpm) between rotor body and screw conveyor during separation phase and discharge phase respectively.

As to the control signals, by means of which the speed of the electrical motors 3*a* and 3*b* should be controlled or adjusted, they may be a function of many different variable factors (e.g., incoming signals from the sensor arrangements such as the vibration sensor V1 on the centrifugal separator and/or the torque sensors Q1 and Q2).

Thus, one or more of the following factors may be included, for instance:

the turbidity of the liquid in the light and/or the heavy liquid outlet (detecting—a growing layer of sludge being accumulated in the rotor body);

the concentration of heavy liquid (water particles) in light liquid (oil) outlet or vice versa (detecting a decrease in separation performance due to growing layer of sludge);

the torque being applied on the screw conveyor by the motor (detecting a growing layer of sludge being accumulated in the rotor body);

the pressure in the light and/or the heavy liquid outlet of the separator (detecting a sludge layer obstructing the liquid flow in the rotor body);

the flow rate and particle concentration of the feed to the separator (to estimate the amount of accumulated sludge in the rotor body);

the vibration amplitude of the rotor body (detecting an unbalance);

the time duration of each separation phase and/or discharge phase (to control and monitor phase-time in manual and automatic operation); and the total operational time in the separation phase and/or discharge phase of the centrifugal separator (indicating a service or repair need).

The centrifugal separator operates in the following manner.

The pulleys 39 and 41 are kept in rotation, by means of the motors 3*a* and 3*b* with belts 40 and 42, around the rotational axis R in the same rotational direction but with somewhat different angular velocities. Thereby, the rotor body 1 and the screw conveyor 2 are kept in rotation at somewhat different rotational speeds.

It is assumed that the rotor body 1 initially doesn't contain any sludge and so when the separation phase of the operating cycle is initiated, the rotor body 1 is accelerated by its motor 3*a* to high speed rotation at a predetermined speed (e.g. at 7500 rpm) through a control signal from the control unit 44. The screw conveyor 2 being rotated at a somewhat different speed (e.g. a differential speed of 1-2 rpm) by means of the motor 3*b* and the gear device 3*c*, whereby the differential speed is set through a control signal in the signal cable 45*b* from the control unit 44. The mixture of liquid and particles is introduced into the rotor body 1 from above through the inlet pipe 13. The mixture flows into the inlet chamber 15 and further through the distribution channels 17, in which it is brought into rotation by the wings 18 and thereby subjecting the mixture to a centrifugal force. A free liquid surface is formed after a while in the rotor body 1 at the level 46, the position of which is determined by the radial position of the holes 23 in the upper support plate 20 at the light liquid outlet chamber 25. The liquid(s) and particles are separated in the separation chamber 16 comprising the stack of separation discs 19. The separated heavy liquid flows through the radially outer annular space 30, through the holes 29 in the conveyor shaft 8 and out of the centrifugal separator through the heavy liquid outlet chamber 31 by means of the paring disc 32. The separated light liquid flows through the radially inner annular space 24, through the holes 23 in the upper support plate 20 and out of the centrifugal separator through the light liquid outlet chamber 25 by means of the paring disc 26.

The separated solids deposit on the inside of the surrounding wall of the rotor body 1. Even if the screw conveyor 2 doesn't discharge any sludge during the separation phase, said screw conveyor 2 through said differential speed will at least distribute and work on the sludge inside the rotor body 1 to reduce the initially mentioned negative effects caused by compressed and uneven distributed sludge. Within a first predetermined time the deposited particles will cause the sludge layer to grow radially inwards towards the axis of rotation R. Before the growing layer of sludge becomes a problem, the control unit 44 will initiate the particle discharge phase of the present invention. This may be initiated after the first predetermined time or after a sensed operating parameter of the centrifugal separator has reached a threshold value. During the particle discharge phase of the operating cycle (e.g., a second predetermined time), the rotor body 1 is brought to rotate at a slower speed (e.g. 1500 rpm) by its motor 3*a*, whereby the centrifugal forces are decreased so that the screw conveyor 2 may transport the sludge towards and out of the outlet 34 more easily. Hence, in the discharge phase the separated particles are transported in the form of sludge along the surrounding wall downwardly and out through the outlet 34, which is also referred to as the initially mentioned sludge outlet 34 for solid particles. During the discharge phase the control unit 44 may control the screw conveyor motor 3*b* to increase the differential speed (e.g. to a differential speed of 3-6 rpm), whereby the sludge will be discharged at an increased rate. When essentially all of the sludge or at least a sufficient amount of sludge has been discharged from the rotor body 1 (e.g., after the second predetermined time) via the sludge outlet 34 for solid particles, the control unit 44 will instruct the motors 3*a* and 3*b* to accelerate the rotor body 1 and the screw conveyor 2 back to high speed rotation with said differential speed in the separation phase of the next operating cycle.

The invention is not limited to the embodiment disclosed but may be varied and modified within the scope of the claims set out below. The invention is not limited to the orientation of the axis of rotation R disclosed in the figures. The term "centrifugal separator" also comprises centrifugal separators with a substantially horizontally oriented axis of rotation. The invention is not limited to the drive arrangement including the specific gear device 3*c*. Other known gear devices such as planetary gear dives may also be used. The drive arrangement may also comprise a direct drive adapted to rotate the screw conveyor, wherein direct drive includes a motor stator connected to the rotor body and a motor rotor connected to the screw conveyor shaft.

The invention claimed is:

1. A centrifugal separator for separating solid particles from a liquid mixture, said centrifugal separator comprising:

a rotor body which is rotatable around a vertical axis of rotation, the rotor body having a separation chamber with an inlet for the liquid mixture, the inlet being positioned above the separation chamber, the separation chamber comprising a stack of truncated conical separation discs disposed therein, the separation discs having at least one flow channel formed therein, a first liquid outlet in communication with the at least one flow channel for discharging a first separated liquid from the liquid mixture, a second liquid outlet in communication with the at least one flow channel for discharging a second separated liquid from the liquid mixture, the second separated liquid having a density greater than that of the first separated liquid, the first liquid outlet and the second liquid outlet being positioned above the separation chamber;

a sludge outlet for the separated solid particles, the sludge outlet being separate from the first liquid outlet and the second liquid outlet and being positioned on a bottom side of the centrifugal separator, a screw conveyor adapted to rotate in the rotor body around the vertical axis of rotation, at a conveyor speed differing from the rotational speed of the rotor body, for transporting the separated solid particles in the separation chamber towards and out of the sludge outlet, and a drive arrangement adapted to rotate the rotor body and the screw conveyor at their respective speeds, a control unit which is adapted to control the drive arrangement to control the speed of both the rotor body and the conveyor during both a separation phase and a particle discharge phase, the control unit being adapted to control the drive arrangement by receiving incoming signals from at least one sensor arrangement, processing the incoming signals and generating control signals for receipt by the drive arrangement to rotate the rotor body at a first speed during the separation phase and at a second speed, which is lower than the first speed, during the particle discharge phase;

the control unit being configured to increase sludge discharge by decreasing rotor speed so that the sludge discharge during the particle discharge phase is greater than the sludge discharge during the separation phase;

the control unit being configured to control the drive arrangement to cycle the centrifugal separator through operations in the separation phase and the particle discharge phase;

the rotor body having a weight suitable for cyclic acceleration between the separation phase and the particle discharge phase; and the control unit being adapted to control the drive arrangement to rotate the rotor body at the first speed during the separation phase for a first predetermined time based on a magnitude of a sludge layer extending radially inward from an inner wall of the rotor body, as measured by the at least one sensor arrangement, after the first predetermined time in the separation phase the control unit automatically initiating the particle discharge phase for a second predetermined time based upon a quantity of sludge discharged from the rotor body, as measured by the at least one sensor arrangement and during which the control unit controls the drive arrangement to control the rotor body at the second speed and to control conveyor speed, thereby discharging the separated particles via the sludge outlet, separate from the separated liquid, and wherein the control unit is configured to control the drive arrangement to accelerate the rotor body to the first speed, after the second predetermined time in the particle discharge phase.

2. A centrifugal separator according to claim 1, wherein said control unit is adapted to control the drive arrangement to rotate the screw conveyor at a different speed than the rotor body during both the separation phase and the particle discharge phase.

3. A centrifugal separator according to claim 2, wherein said control unit is adapted to control the drive arrangement to change the differential speed between the screw conveyor and the rotor body in the particle discharge phase relative the separation phase.

4. A centrifugal separator according to claim 1, wherein said control unit is adapted to initiate the particle discharge phase when receiving a threshold value from the at least one sensor arrangement.

5. A centrifugal separator according to claim 1, wherein the centrifugal separator is arranged to reduce or interrupt a feed of the mixture through the inlet during the particle discharge phase.

6. A centrifugal separator according to claim 1, wherein the rotor body is rotatably supported only at its one end through a rotor shaft.

7. A centrifugal separator according to claim 6, wherein the inlet comprises an inlet pipe, which extends into the rotor body at its one end, said first liquid outlet and said second liquid outlet each including at least one outlet channel, which extends out of the rotor body at its one end, and the sludge outlet for separated solids situated at the opposite other end of the rotor body.

8. A method for separating solid particles from a liquid mixture in a centrifugal separator, the method comprising:

providing a centrifugal separator comprising:

a rotor body which having a vertical axis of rotation, the rotor body having a separation chamber with an inlet for the liquid mixture, the inlet being positioned above the separation chamber, the separation chamber comprising a stack of truncated conical separation discs disposed therein, the separation discs having at least one flow channel formed therein, the rotor body having a weight suitable for cyclic acceleration between a separation phase and a particle discharge phase, a first liquid outlet in communication with the at least one flow channel, a second liquid outlet in communication with the at least one flow channel and the first liquid outlet and the second liquid outlet being positioned above the separation chamber, a sludge outlet separate from the first liquid outlet and the second liquid outlet and being positioned on a bottom side of the centrifugal separator, a screw conveyor adapted to rotate in the rotor body around the vertical axis of rotation, at a conveyor speed differing from the rotational speed of the rotor body, a drive arrangement in communication with the rotor body and the screw conveyor, and a control unit in communication with the drive arrangement;

the control unit receiving incoming signals from at least one sensor arrangement, processing the incoming signals and generating control signals and transmitting the control signals to the drive arrangement so that the control unit controls the drive arrangement to control the speed of both the rotor body and the conveyor during both the separation phase and the particle discharge phase, the control unit being adapted;

rotating, with the drive arrangement, the rotor body and the screw conveyor around the vertical axis at their respective speeds;

discharging a first separated liquid from the liquid mixture via the first liquid outlet;

discharging a second separated liquid from the liquid mixture via the a second liquid outlet, the second separated liquid having a density greater than that of the first separated liquid;

rotating the screw conveyor in the rotor body around the vertical axis of rotation, at a conveyor speed differing from the rotational speed of the rotor body, for transporting the separated solid particles in the separation chamber towards and out of the sludge outlet;

controlling the drive arrangement, via the control unit, to rotate the rotor body at a first speed during the separation phase and at a second speed, which is lower than the first speed, during the particle discharge phase;

increasing sludge discharge, via the control unit, by decreasing rotor speed so that the sludge discharge during the particle discharge phase is greater than the sludge discharge during the separation phase;

controlling the drive arrangement, via the control unit, thereby cycling the centrifugal separator through operations in the separation phase and the particle discharge phase;

cyclically accelerating the rotor body between the separation phase and the particle discharge phase;

controlling, with the control unit, the drive arrangement to rotate the rotor body at the first speed during the separation phase for a first predetermined time based on a magnitude of a sludge layer extending radially inward from an inner wall of the rotor body, as measured by the at least one sensor arrangement, after the first predetermined time in the separation phase the control unit automatically initiating the particle discharge phase for a second predetermined time based upon a quantity of sludge discharged from the rotor body, as measured by the at least one sensor arrangement and during which the control unit controls the drive arrangement to control the rotor body at the second speed and to control conveyor speed, thereby discharging the separated particles via the sludge outlet, separate from the separated liquid; and controlling, via the control unit, the drive arrangement to accelerate the rotor body to the first speed, after the second predetermined time in the particle discharge phase.

9. A method according to claim 8, wherein the screw conveyor is caused to rotate at a different speed than the rotor body during both the separation phase and the particle discharge phase.

10. A method according to claim 9, wherein the differential speed between the screw conveyor and the rotor body is changed in the particle discharge phase relative the separation phase.

11. A method according to claim 8, wherein an operating parameter of the centrifugal separator is measured and the particle discharge phase is initiated when the operating parameter reaches a threshold value.

12. A method according to claim 8, wherein the feed of the mixture through the inlet is reduced or interrupted during the particle discharge phase.

13. A centrifugal separator according to claim 1, wherein the second predetermined time is based upon a viscosity of the sludge.

14. A centrifugal separator according to claim 1, wherein the screw conveyor is a one piece unit manufactured from a plastic material.

15. A centrifugal separator according to claim 3, wherein the changing of the differential speed comprises increasing the differential speed.

16. A method according to claim 10, wherein the changing of the differential speed comprises increasing the differential speed.

* * * * *